US009044363B2

(12) United States Patent
Tanguay

(10) Patent No.: US 9,044,363 B2
(45) Date of Patent: Jun. 2, 2015

(54) HAND-HELD VOMIT AND URINAL BAG HOLDER

(75) Inventor: Eric Tanguay, Candiac (CA)

(73) Assignee: Hygie Canada Inc., Brossard (Quebec) (CA)

( * ) Notice: Subject to any disclaimer, the term of this patent is extended or adjusted under 35 U.S.C. 154(b) by 169 days.

(21) Appl. No.: 12/788,361

(22) Filed: May 27, 2010

(65) Prior Publication Data

US 2010/0305525 A1 Dec. 2, 2010

Related U.S. Application Data

(63) Continuation-in-part of application No. PCT/CA2009/000756, filed on May 29, 2009.

(60) Provisional application No. 61/182,522, filed on May 29, 2009, provisional application No. 61/057,960, filed on Jun. 2, 2008.

(51) Int. Cl.
*A61J 1/00* (2006.01)
*A61G 9/00* (2006.01)

(52) U.S. Cl.
CPC ..... *A61G 9/006* (2013.01)

(58) Field of Classification Search
USPC ..... 220/403, 404, 908, 9.4, 495.01–495.11, 220/743, 741, 739, 737; 383/11, 22, 33, 383/61.1, 92; 128/292, 295, 275, 2 F, 128/DIG. 24; 229/117.03, 117.09, 117.21, 229/117.23, 114, 167, 169, 172, 915, 229/125.22, 125.31, 162.6, 190, 195, 196; 604/317, 322, 385.01; 224/148.1, 224/148.4–148.7
See application file for complete search history.

(56) References Cited

U.S. PATENT DOCUMENTS

| | | | | | |
|---|---|---|---|---|---|
| 445,719 | A | * | 2/1891 | Schillinger | 220/737 |
| 1,061,769 | A | * | 5/1913 | Meineoke | 604/317 |
| 3,161,891 | A | | 12/1964 | Bauman | |
| 3,177,500 | A | | 4/1965 | Bauman | |
| 3,456,840 | A | * | 7/1969 | McAlaster | 220/741 |
| D216,058 | S | | 11/1969 | Painter et al. | |
| 3,679,125 | A | | 7/1972 | Forance et al. | |
| 3,784,049 | A | * | 1/1974 | Hawk | 220/495.11 |
| D235,081 | S | | 5/1975 | Gatewood | |
| 3,920,179 | A | | 11/1975 | Hall | |
| 3,921,234 | A | | 11/1975 | Mracek et al. | |
| D249,162 | S | | 8/1978 | Mills | |
| 4,103,952 | A | * | 8/1978 | Thompson | 294/1.3 |
| 4,246,944 | A | * | 1/1981 | Dixie | 224/218 |
| D259,511 | S | | 6/1981 | Peterson | |
| 4,280,676 | A | * | 7/1981 | Betts | 248/97 |

(Continued)

FOREIGN PATENT DOCUMENTS

| | | |
|---|---|---|
| CN | 200966771 | 10/2007 |
| DE | 4116596 | 12/1991 |

(Continued)

*Primary Examiner* — Loan H Thanh
*Assistant Examiner* — Andrew S Lo
(74) *Attorney, Agent, or Firm* — Price Heneveld LLP

(57) ABSTRACT

A body liquid bag holder comprising a tubular wall defining a hollow space with an open upper end and a lower end longitudinally opposite the upper end; a liquid body bag attachment adjacent to the upper end of the tubular wall; and at least one apertured handle extending through the tubular wall and adapted and configured to receive at least one finger of a hand of a user for holding the body liquid bag holder.

14 Claims, 13 Drawing Sheets

(56) References Cited

U.S. PATENT DOCUMENTS

| | | | | |
|---|---|---|---|---|
| 4,305,161 | A | 12/1981 | Diaz | |
| D270,018 | S | 8/1983 | Knight | |
| D273,133 | S | 3/1984 | Babic et al. | |
| 4,610,039 | A | 9/1986 | Stern | |
| D286,569 | S | 11/1986 | Nakao et al. | |
| D287,324 | S | 12/1986 | Schmidt | |
| 4,683,598 | A | 8/1987 | Jones | |
| 4,707,864 | A | 11/1987 | Ikematsu et al. | |
| D297,462 | S | 8/1988 | Meunchen | |
| 4,867,339 | A * | 9/1989 | Hahn | 220/495.1 |
| D304,496 | S | 11/1989 | Thomas | |
| 4,982,868 | A * | 1/1991 | Robbins, III | 220/742 |
| D322,940 | S | 1/1992 | Rivera | |
| D341,421 | S | 11/1993 | Jones | |
| D342,784 | S | 12/1993 | Passiak et al. | |
| D349,241 | S | 8/1994 | Isaacson | |
| 5,354,132 | A | 10/1994 | Young et al. | |
| D353,000 | S | 11/1994 | Bradley, Jr. | |
| 5,409,473 | A | 4/1995 | Rosenshein | |
| 5,425,468 | A * | 6/1995 | Birkel et al. | 220/495.11 |
| 5,455,972 | A | 10/1995 | Williams | |
| 5,571,095 | A | 11/1996 | Lu | |
| 5,584,430 | A * | 12/1996 | Mulry | 229/117.16 |
| D379,302 | S | 5/1997 | Rodman | |
| 5,647,670 | A | 7/1997 | Iscovich | |
| D389,240 | S | 1/1998 | Corona | |
| 5,745,926 | A | 5/1998 | Cailleteau | |
| 5,778,461 | A | 7/1998 | Attaway | |
| D399,007 | S | 9/1998 | Jones et al. | |
| D399,308 | S | 10/1998 | Garlock | |
| 5,816,631 | A | 10/1998 | Kochan | |
| 5,842,233 | A | 12/1998 | Broden | |
| D405,526 | S | 2/1999 | Bonelli | |
| D418,060 | S | 12/1999 | De Villiers | |
| D421,170 | S | 2/2000 | Siu | |
| D429,934 | S | 8/2000 | Hofman | |
| 6,210,382 | B1 * | 4/2001 | Hogg | 604/317 |
| D446,845 | S | 8/2001 | Jacuzzi et al. | |
| 6,295,831 | B1 | 10/2001 | Watson | |
| D452,355 | S | 12/2001 | Leyshon | |
| D464,729 | S | 10/2002 | Rehrig | |
| 6,533,140 | B1 * | 3/2003 | Freeman | 220/737 |
| D476,787 | S | 7/2003 | Templeton | |
| D481,236 | S | 10/2003 | Hunt | |
| D481,894 | S | 11/2003 | Hunt | |
| D482,446 | S | 11/2003 | Rainville-Lonn et al. | |
| D488,226 | S | 4/2004 | MacDonald et al. | |
| D489,261 | S | 5/2004 | Doelling | |
| D495,415 | S | 8/2004 | Theodore | |
| D497,981 | S | 11/2004 | Call | |
| 6,874,936 | B2 | 4/2005 | Gillis et al. | |
| 7,029,463 | B1 | 4/2006 | Estudillo | |
| D543,274 | S | 5/2007 | Takahashi | |
| D567,368 | S | 4/2008 | Guptill | |
| D571,460 | S | 6/2008 | Korjack | |
| 7,407,139 | B1 * | 8/2008 | Dolan | 248/99 |
| D579,558 | S | 10/2008 | McBarnett et al. | |
| D580,049 | S | 11/2008 | Tanguay | |
| D583,933 | S | 12/2008 | Finney et al. | |
| D612,181 | S | 3/2010 | Tanguay | |
| 2003/0009140 | A1 * | 1/2003 | Taylor | 604/323 |
| 2004/0195467 | A1 * | 10/2004 | Passage | 248/99 |

FOREIGN PATENT DOCUMENTS

| | | |
|---|---|---|
| EP | 0031396 | 5/1980 |
| EP | 0549850 | 7/1993 |
| EP | 0948304 | 7/1997 |
| GB | 2227728 | 8/1990 |
| WO | 9926868 | 6/1999 |
| WO | 2006049453 | 5/2006 |

* cited by examiner

HAND-HELD VOMIT AND URINAL BAG HOLDER

CROSS-REFERENCE TO RELATED APPLICATIONS

This application claims priority under 35 USC §119(e) of U.S. provisional patent application 61/057,960 filed Jun. 2, 2008 and U.S. provisional patent application 61/182,522 filed May 29, 2009, the specifications of which are hereby incorporated by reference. This application is a continuation-in-part of PCT patent application serial number PCT/CA2009/000756 filed May 29, 2009, designating the United States of America, now pending, the specification of which is hereby incorporated by reference.

TECHNICAL FIELD

The invention relates to holders for vomit or urinal bags, more particularly to portable holders holding a vomit bag for use by a patient during vomiting episodes or a urinal bag.

BACKGROUND OF THE ART

Medical conditions or unusual situations, such as stress-related situations, can lead to vomiting by a subject. It is known to provide vomit bags to subjects potentially exposed to such conditions or situations, in order to allow them to collect the vomit right from the mouth or nose before it reaches the ground, another being or an object of the subject's environment. Typically, the subject grabs the vomit bag by both sides and positions it aligned with and adjacent to his mouth and/or nose.

Since vomiting is a sudden and often unpredictable condition, the gripping of the vomit bag and opening before positioning it near the mouth and nose is not always possible. Also, the grabbing force of the hands should be sufficient for resisting to the expulsion force of the vomit so that the subject will not drop the bag. This can be complicated by the momentary increase in involuntary movements occurring during vomiting.

In addition, subject having limited or restrained use of their hands are unable to use such vomit bags by themselves, including paralyzed or unconscious subjects. Also, subjects surprised by the need to vomit while resting or sleeping rarely have the time to reach for a vomit bag, open it, and position it in front of their mouths and noses.

There are also situations wherein toilets are unavailable or inaccessible, especially for women which often have a need to urinate in a standing position. Furthermore, when toilets are unavailable or inaccessible, frequently urine must be collected and a urinal bag or container is used.

After use, a typical vomit or urinal bag cannot be put aside, even for a small moment, before being carried to disposal because the soft nature of the bag will often cause it to tilt and spill its content.

Therefore, there is a need for allowing use of a pre-opened vomit or urinal bag by a subject. There is also a need for a system allowing the subject a better grip of the vomit or urinal bag to ensure it will stay in place during the vomiting or urinating.

SUMMARY

It is an object of the present invention to provide a hand-held vomit or urinal bag holder which addresses at least one of the above-mentioned needs.

In accordance is a first aspect of the invention, there is provided a hand-held vomit bag holder comprising a tubular wall defining a hollow space adapted to receive a vomit bag, and having an upper end and a lower end longitudinally opposite the upper end; a vomit bag attachment adjacent to the upper end of the tubular wall; and a first apertured handle extending through the tubular wall and adapted and configured to receive at least one finger of a first hand of a user for holding the vomit bag holder.

In an embodiment, the vomit bag holder has a gripping arm including a downwardly protruding arm of a rear wall section of the tubular wall extending from the upper end of the tubular wall, spaced-apart from apertured side wall sections of the tubular wall, and engageable with a graspable structure. The downwardly protruding arm can be flexibly and resiliently attached to the upper end of the tubular wall.

In an embodiment, at least the upper end is open and communicating with the space inside the tubular body to allow removable insertion of a body of a vomit bag with an open end of the vomit bag being held by the bag attachment.

The upper end can have an outwardly and downwardly extending rim forming part of the vomit bag attachment. The hand-held vomit bag holder can be substantially obround. The upper end at a rear of the vomit bag holder can be raised higher than the upper end at a front of the vomit bag holder.

In accordance with another aspect, there is provided a vomit bag holder comprising a tubular wall defining a hollow space adapted to receive a vomit bag, and having an upper end and a lower end longitudinally opposite the upper end, the length of tubular wall between the upper end and the lower end being at least that of the width of four fingers of a user; a vomit bag attachment adjacent to the upper end of the tubular wall; and at least a first and a second diametrically opposed neck strap connectors adjacent to the upper end of the tubular wall for detachably attaching a neck strap to the neck strap connectors.

In accordance with yet another aspect, there is provided a vomit bag holder comprising a tubular wall defining a hollow space adapted to receive a vomit bag, and having an upper end and a lower end longitudinally opposite the upper end; a vomit bag attachment adjacent to the upper end of the tubular wall; and a downwardly protruding arm extending from the upper end of the tubular wall, spaced-apart from the tubular wall, and engageable with a graspable structure.

In accordance with yet another aspect, there is provided a vomit bag holder comprising a tubular wall defining a hollow space adapted to receive a vomit bag, and having an upper end and a lower end longitudinally opposite the upper end; a vomit bag attachment adjacent to the upper end of the tubular wall; an apertured handle extending through the tubular wall and adapted and configured to receive at least one finger of a user; at least a first and a second diametrically opposed neck strap connectors adjacent to the upper end of the tubular wall; and a downwardly protruding arm extending from the upper end of the tubular wall, spaced-apart from the tubular wall, and engageable with a graspable structure.

In accordance with yet another aspect, there is provided a hand-held vomit bag holder comprising a tubular body having a first end with a bag attachment, a second end longitudinally opposite the first end, and a space inside the tubular body, at least the first end being open and communicating with the space inside the tubular body to allow removable insertion of a body of a vomit bag with an open end of the vomit bag being held by the bag attachment; the vomit bag holder being characterized in that the length of tubular body between the first end and the second end is at least that of the width of four fingers of a user.

In accordance is an aspect of the invention, there is provided a portable urinal device comprising a tubular wall defining a hollow space adapted to receive a hygienic bag, and having an open upper end and a lower end longitudinally opposite the upper end; a hygienic bag attachment adjacent to the upper end of the tubular wall; and a first apertured handle extending through the tubular wall and adapted and configured to receive at least one finger of a first hand of a user for holding the urinal device.

In accordance is another aspect of the invention, there is provided a body liquid bag holder comprising a tubular wall defining a hollow space with an open upper end and a lower end longitudinally opposite the upper end; a body liquid bag attachment adjacent to the upper end of the tubular wall; and at least one apertured handle extending through the tubular wall and adapted and configured to receive at least one finger of a hand of a user for holding the body liquid bag holder.

In this specification, the term "vomit" is intended to mean liquids, solids or a combination of both, expulsed forcefully from one's body through the mouth and sometimes the nose. It is used as a synonym for body waste, throw up contents, body fluid or liquid, emesis discharge, regurgitation, etc.

In this specification, the term "user" is intended to mean a human being susceptible of vomiting or urinating. It includes adults and children, patients in hospitals, pregnant women, sick individuals, nauseating subjects, etc.

In this specification, the term "urine" is intended to mean an aqueous product secreted by the kidneys. It includes blood such as menstrual blood which can flow simultaneously.

In the specification, the term "body liquids" include urine, vomit, menstrual blood, and the like.

BRIEF DESCRIPTION OF THE DRAWINGS

Having thus generally described the nature of the invention, reference will now be made to the accompanying drawings, showing by way of illustration a preferred embodiment thereof and in which.

It will be noted that throughout the appended drawings, like features are identified by like reference numerals.

DETAILED DESCRIPTION

Figure 1:
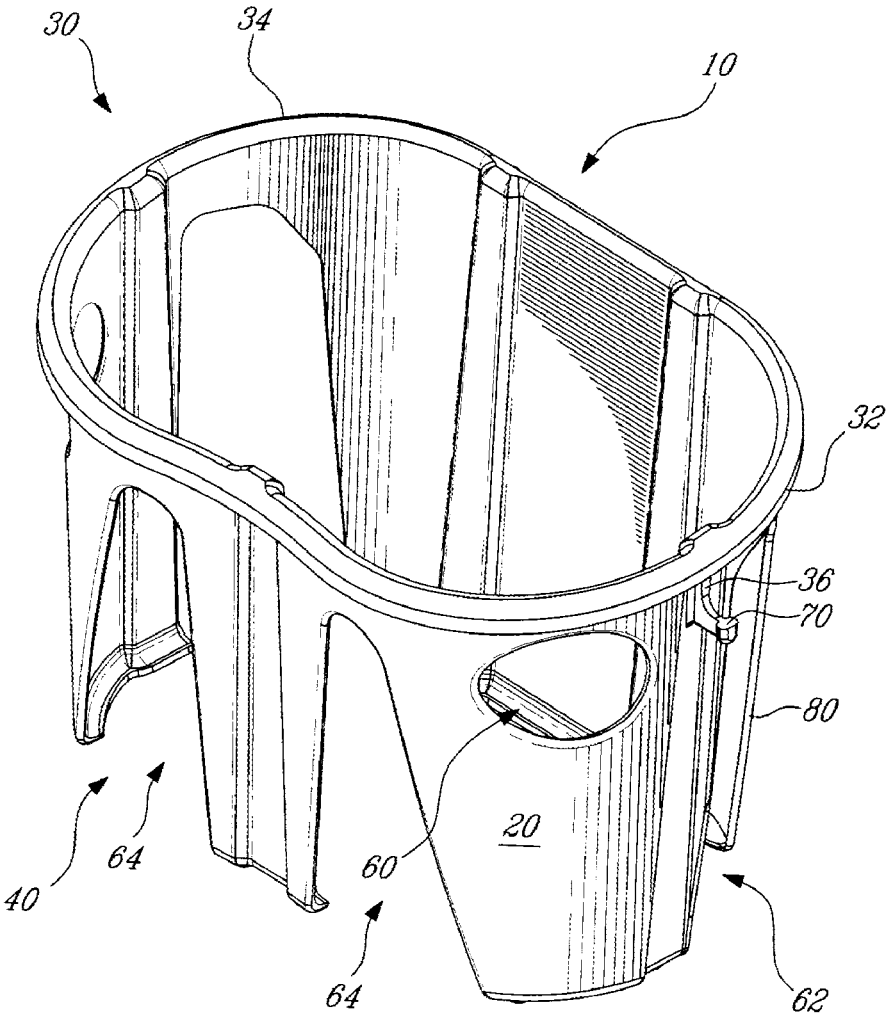
FIG. 1 is a perspective view of an embodiment of a hand-held vomit bag holder.

Referring now to the figures, an example of a vomit bag holder is designated by numeral 10 in FIG. 1. The vomit bag holder 10 has a tubular wall 20 forming the body of the vomit bag holder 10 and defining a hollow space. The tubular wall 20 has an upper end 30 longitudinally opposite to a lower end 40. The transversal cross-section of the vomit bag holder is of obround shape with a slight curve along one of the straight sides in this example, although other cross-sectional shapes can be used in alternate embodiments. In the illustrated embodiment, the vomit bag holder has a width of 4.639 inches and a length of 7.53 inches.

The flat lower end 40 of tubular wall 20 allows to rest the vomit bag holder 10 on a flat horizontal surface without spilling the contents of a vomit bag (see FIG. 6) mounted thereto, for example.

The height of the back of the vomit bag holder is greater than the height of the front of the vomit bag holder. In the illustrated example, the height of the front of the vomit bag holder 10, which corresponds to the distance between the front side of the upper end 30 and the lower end 40 is at least the width of four fingers. The height of the back of the vomit bag holder 10 is greater than that of the front to ensure that a higher proportion of the expulsed vomit is caught by the vomit bag. In this case, it is about 5.22 inches at the back and about 4.475 inches at the front.

Figure 2:
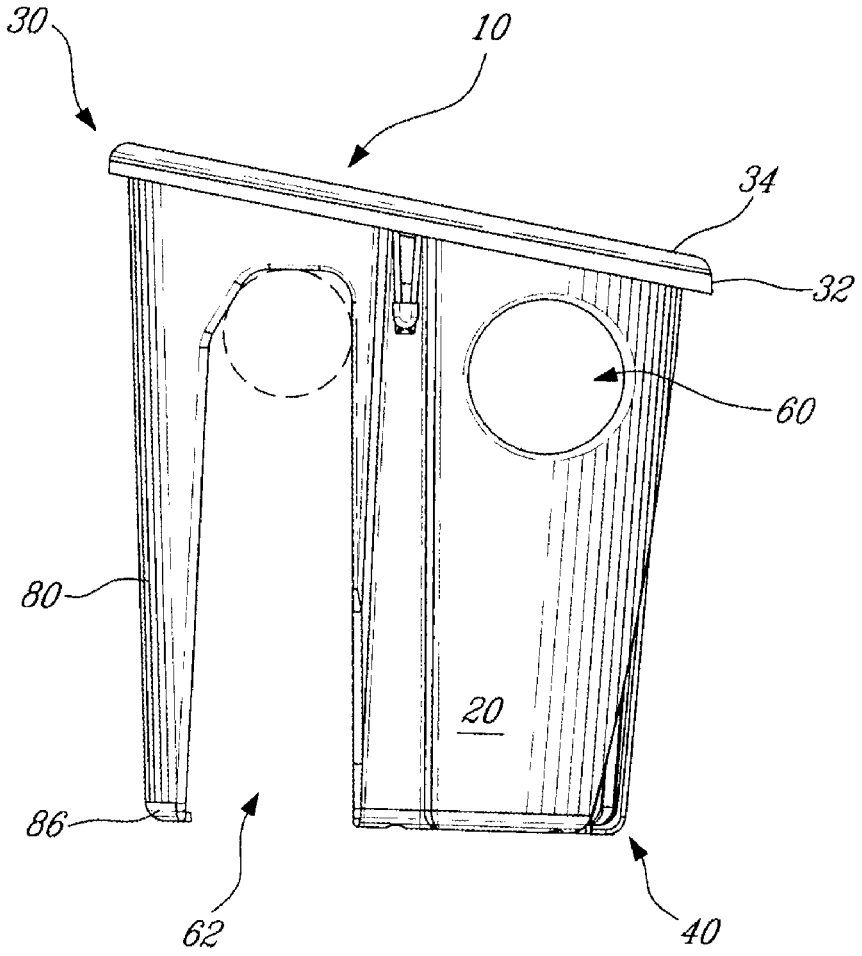
FIG. 2 is a left side view of the vomit bag holder shown in FIG. 1.
Figure 3:
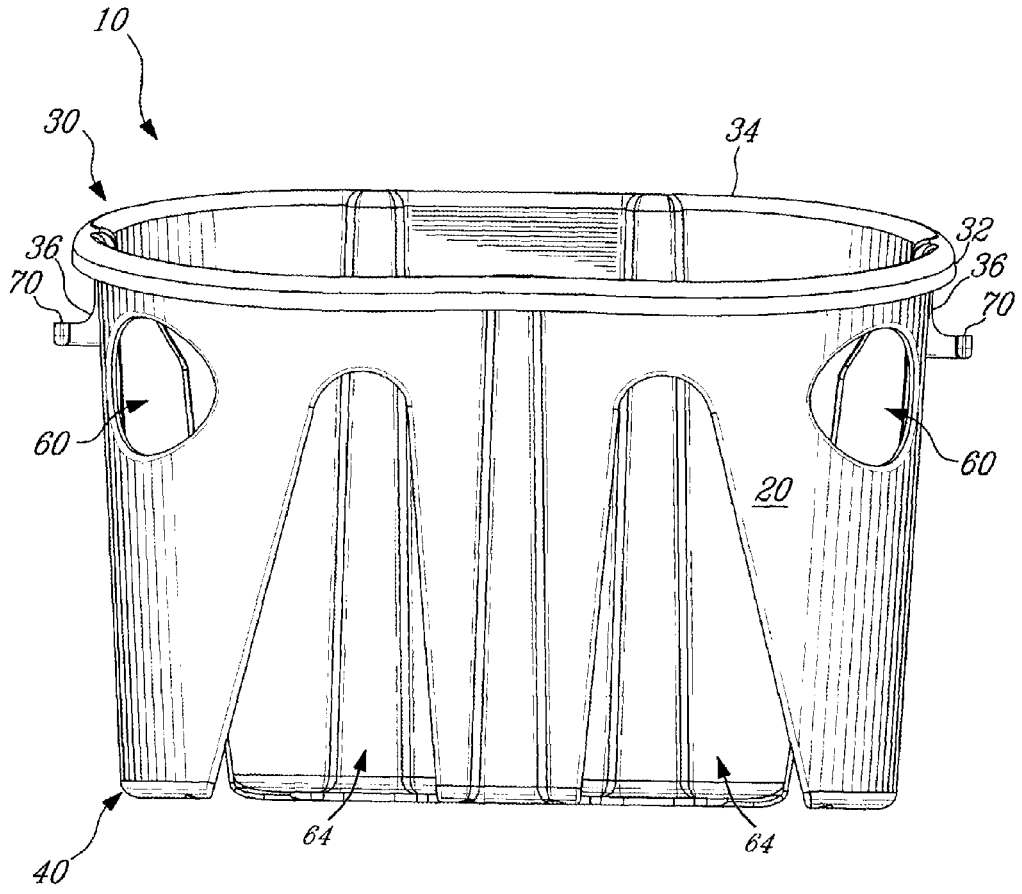
FIG. 3 is a front view of the vomit bag holder shown in FIG. 1.

The ends 30 and 40, particularly the upper end 30, can have a blunt or a rounded shape. The tubular wall 20 can also outwardly bend at an end, particularly at the upper end 30, in a pointed or rounded way, to bend the upper end 30 of the tubular wall 20 below the top 34 of the vomit bag holder 10, as illustrated in FIG. 1. In an embodiment, the upper end 30 and lower end 40 are defining a substantially flat end to the tubular wall 20, as illustrated in FIG. 2 and FIG. 3. Various designs can be applied to the upper end 30 and lower end 40 of the tubular wall 20, and to the top 34 of the vomit bag holder, in order to increase comfort when in contact with or near the mouth and nose of a user.

The upper end 30 and the lower end 40 can be formed by the continuity of the tubular wall 20 and produced as such, or be assembled to the tubular wall 20 after being separately manufactured. The upper end 30 and lower end 40 can be made of a different material than the tubular wall 20, such as, for example, a material having an improved adherence or an improved rigidity over the material of the tubular wall 20.

Located at or near the upper end 30 is a bag attachment. The vomit bag holder is designed for use with disposable vomit bags which are shaped to fit the particular design of the holder, and to be removably securable to the attachment. Typically, the body portion of a vomit bag is inserted into the hollow space defined by the tubular wall 20, with the open end of the vomit bag being secured to the attachment, at the upper end 30 of the tubular wall 20.

Shown in FIG. 1 is a bag attachment including the outwardly and downwardly extending rim 32 spaced-apart from the upper end 30 and defining, with the tubular wall, a peripheral channel. The peripheral channel is designed to receive therein receives the upper periphery of the vomit bag. The closure means of the bag can be used to secure the bag to the holder. For example, if the bag comprises a closure string slidably mounted to an upper end of the bag, the closure string can be used to secure the opening of the bag to the rim. The string is inserted in the channel and tightened to secure the vomit bag to the vomit bag holder 10. The vomit bag, secured to vomit bag holder 10, extends over the rim 32 and in the hollow space. In this example, the bag measures 25 cm by 25 cm.

Alternatively, the vomit bag can include an elastic band (not shown) which secures the vomit bag to the vomit bag holder 10 by applying pressure to the outer face of the vomit bag holder, proximate to the upper end 30.

Examples of other bag attachment includes, without limitations, a pressure-operated attachment of the vomit bag onto the whole upper end 30 of the vomit bag holder 10, a Velcro™-like attachment to or near the upper end 30, or a plurality of attachment points such as protrusions, tips, pins, slits, snaps and the likes. Care must, however, be taken in choosing the attachment as perforation or breakage of the vomit bag while held in the holder is to be avoided.

Figure 6:
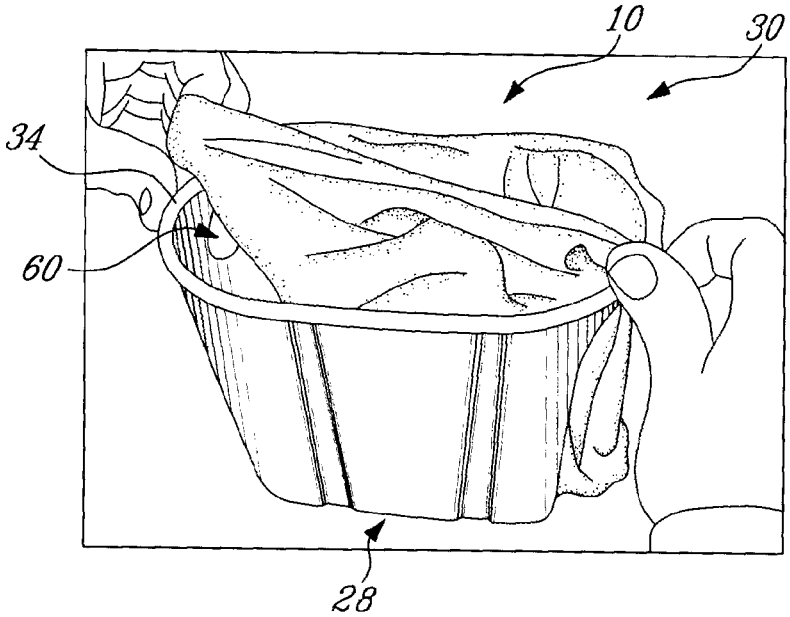
FIG. 6 is a illustration of a user placing the vomit bag inside the vomit bag holder, opening the vomit bag and securing the vomit bag to the bag attachment of the holder shown in FIG. 1.

Prior to use, the body of the vomit bag is positioned into the hollow space defined by the tubular wall 20 and the open end of the vomit bag is maintained in an open state by being attached to the bag attachment of the vomit bag holder 10. This arrangement allows for a ready access and immediate use of the vomit bag, the vomit bag being secured in an open position by the bag attachment. This is shown in FIG. 6. The vomit bag holder is placed on a table by the user to facilitate the placement of the vomit bag within the vomit bag holder.

Figure 5:
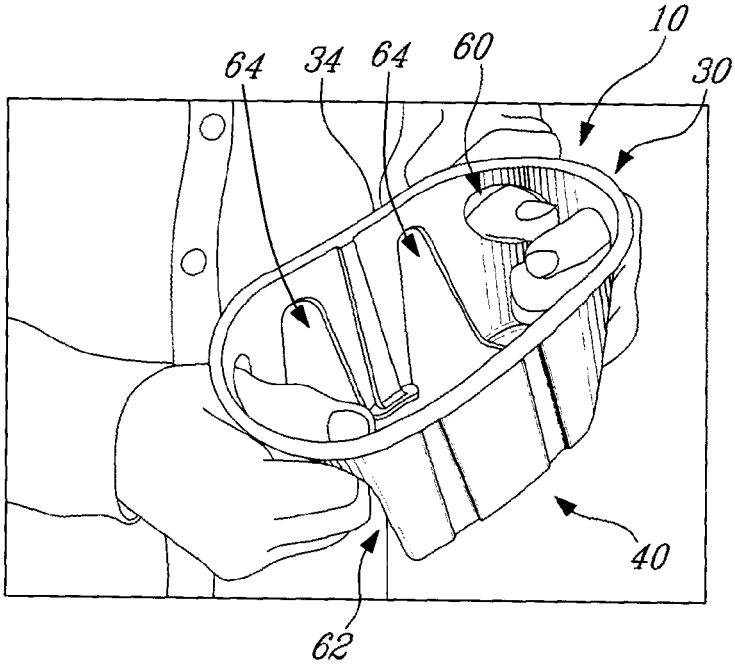
FIG. 5 is a illustration of a user grabbing the vomit bag holder shown in FIG. 1 in his hands.
Figure 7:
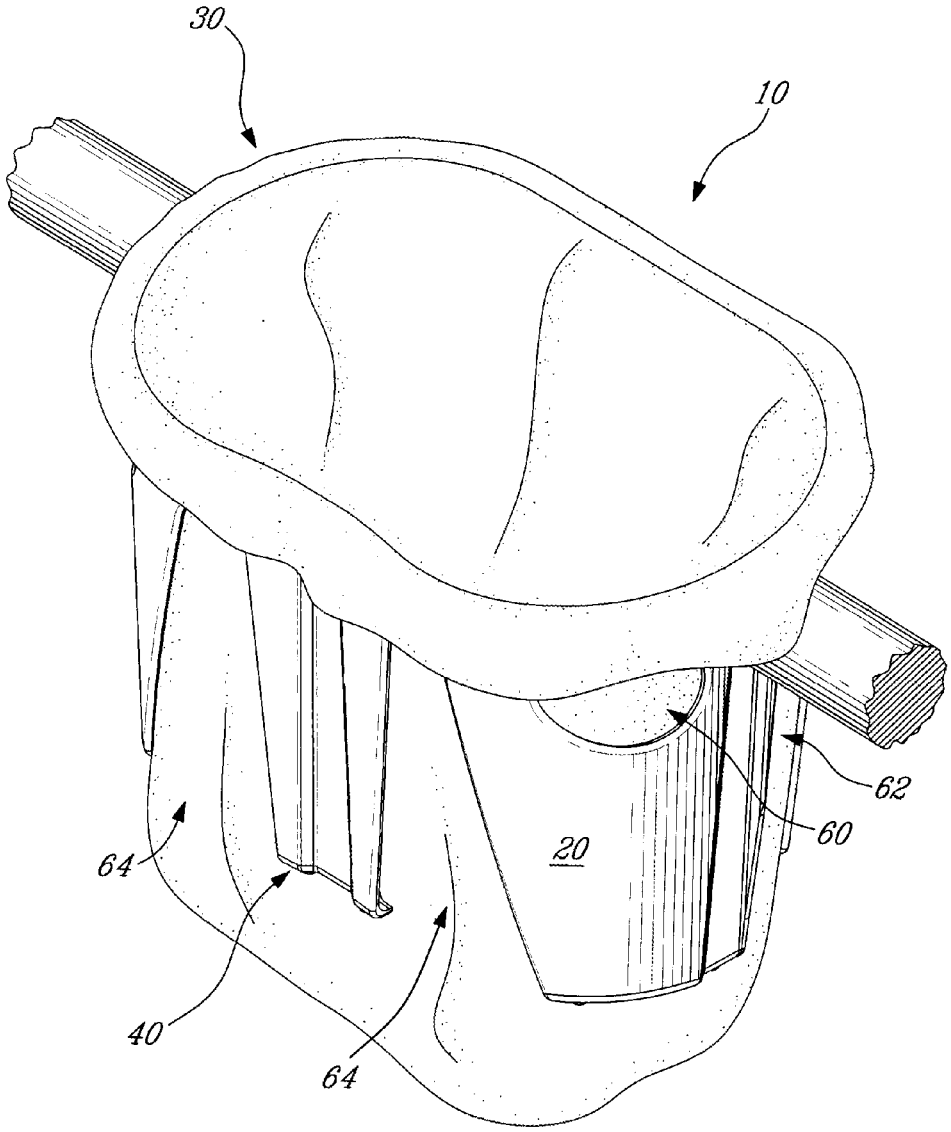
FIG. 7 is a perspective view of the vomit bag holder shown in FIG. 1 provided with a vomit bag for use and gripped to a rail of a hospital bed.

In use, the user firmly grasps the vomit bag holder 10 by holding it on both sides with the palm of the hand and his fingers. FIG. 5 shows a user grabbing the vomit bag holder shown in FIG. 1 in his hands. FIG. 7 shows the vomit bag holder provided with a vomit bag. In FIG. 5, the vomit bag holder is not provided with a vomit bag to allow visualization of the placement of the fingers of the user. The user lifts the vomit bag holder next to his face and places his mouth and nose aligned with and adjacent to the obround hollow space. The user is then able to vomit inside the vomit bag provided in the vomit bag holder.

After use, gravity acts on the vomit inside the vomit bag, which retains the vomit bag within the vomit bag holder 10 by the bag attachment. After use, the substantially planar lower end 40 of the vomit bag holder can be momentarily deposited on a planar surface to allow the user to rest, prior to having to dispose of the used vomit bag.

In the illustrated embodiment, the lower end 40 of the vomit bag holder 10 is open. In alternate embodiments, it can be closed.

Figure 4:
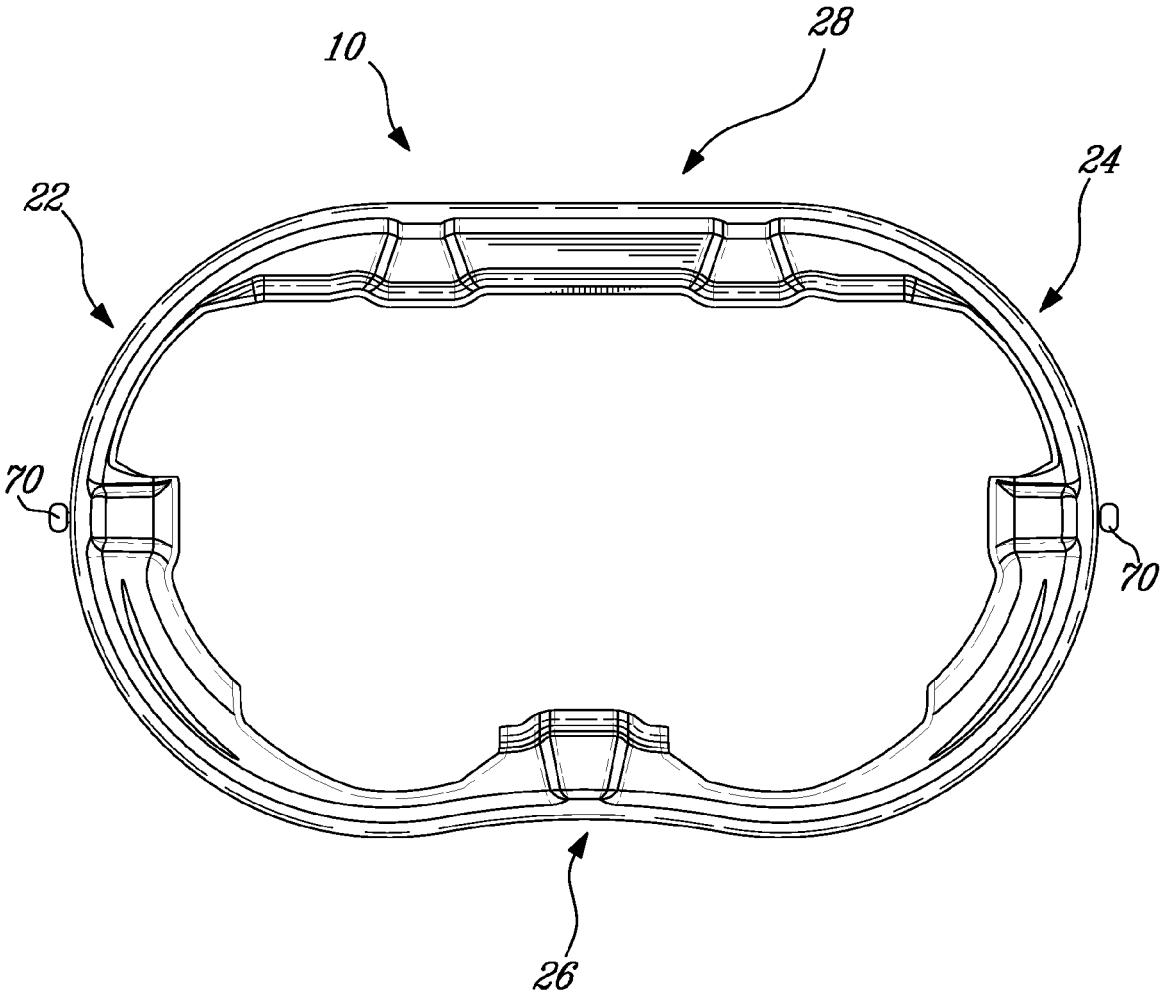
FIG. 4 is a top view of the vomit bag holder shown in FIG. 1.

The generally obround shape of the illustrated vomit bag holder 10 defines a left side 22, a right side 24, a front side 26 and a rear side 28 of the tubular wall 20, as illustrated in FIG. 4. While, in the embodiment shown, the left side 22 and the right side 24 are semi-circular, and the front side 26 and rear side 28 are substantially straight to form the general obround shape of the vomit bag holder 10. In various embodiments, they can be of any shape allowing the formation of a sufficiently large hollow space to receive vomit from the user. As illustrated, the front side 26 can define a slight curved recess which can allow for an improved comfort of the user.

In the illustrated embodiment, a set of two apertured handles, exemplified as thumb openings 60 in FIG. 1, are defined through the tubular wall on opposite transversal sides, and an additional set of two apertured handles, exemplified as slit openings 62 in FIG. 1, on opposite transversal sides allow the user to insert his fingers therein. This helps the user in firmly grasping the tubular wall and for preventing the holder and the bag held therein from sliding downwardly when a downward vomiting force is exerted thereon. On each side, the combination of the thumb opening 60 and of the slits opening 62 form a handle. In the illustrated embodiment, thumb openings 60 have a radius of 0.594 inches and slit openings 62 have a width of 1.284 inches.

In alternate embodiments, different shapes or forms of handles can be used instead of the handle described above and depicted. Also, a different configuration of openings can be provided. For example, at least one of the left side 22 and right side 24 of the vomit bag holder 10 can have an opening 60 allowing for at least one finger to be inserted into the tubular wall 20. This opening 60 allows for the user to securely and firmly grab the vomit bag holder 10. The opening 60 can receive any fingers, including the thumb, or a plurality of fingers from a single hand. A plurality of openings 60 can be present on at least one of the left side 22 and right side 24 to accommodate a plurality of fingers from a single hand. In an embodiment, the opening 60, or plurality of openings 60, on the left side 22 is symmetrically reproduced on the right side, forming at least a pair of openings 60 on each sides. The pair or plurality of pairs of openings 60 on each of the left side 22 and right side 24 can be diametrically opposed, or arranged in any other way to allow for a firm grip of the vomit bag holder 10 by the user and ensure the stability of the vomit bag holder 10 during and after use, whether the bag holder 10 is held by the user or put aside in any way described herein. Alternatively, at least one opening on at least one of the left side 22 and the right side 24 can take the form of a recess or slit 62 in the lower end 40 of the tubular wall 20, allowing for the insertion of at least one finger, preferably four fingers, from a single hand to be inserted into the tubular wall 20. In the embodiment shown in FIGS. 1 to 7, the vomit bag holder 10 further comprises a set of two slit openings 64 provided in the front side 26 extending upwardly from the lower end 40 of the tubular wall 20.

Figure 8:
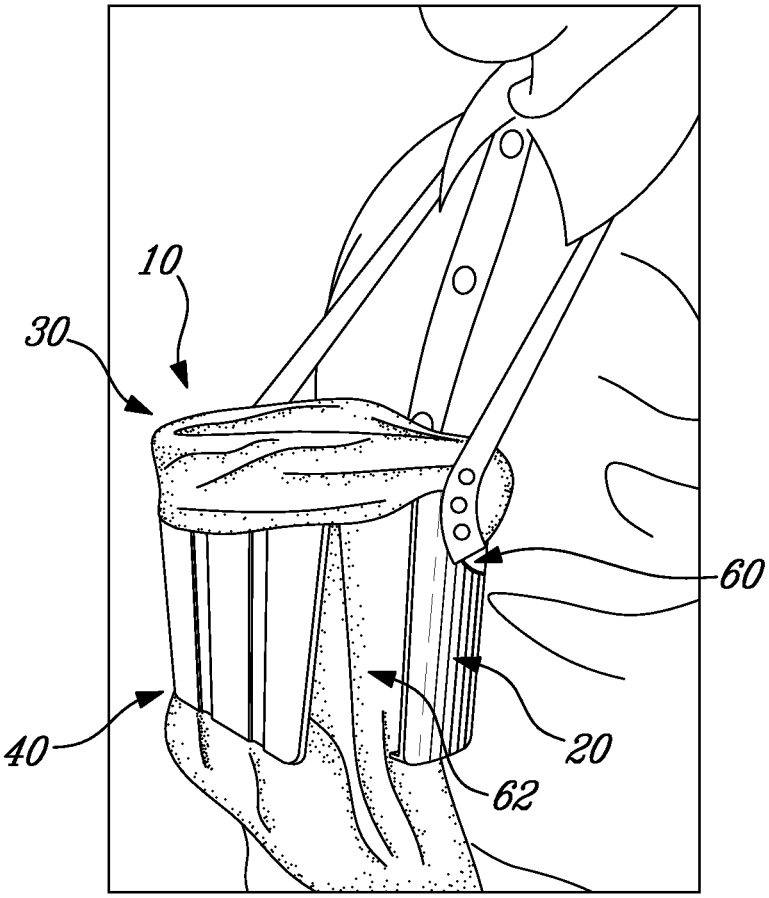
FIG. 8 is a illustration of a user wearing the vomit bag holder provided with a vomit bag using a neck strap around his neck.

In an embodiment, the upper end 30 further includes a neck strap connector 70 to detachably attach a neck strap which is to be used to attach the vomit bag holder to the neck of a user, with the holder in ready position below the mouth of the user. The neck strap connector 70 can be a protrusion, a recess, or any other attachment, and is located at or near the upper end 30. In an embodiment illustrated in FIG. 1, the neck strap connector 70 is a protrusion extending outwardly from a downwardly extending protrusion 36 of the outwardly bent upper end 30. Any other type of neck strap connector 70 allowing for the attachment of a neck strap for the suspension of the vomit bag holder 10 in a stable manner, i.e. by ensuring the upward position of the vomit bag holder 10, prior, during or after use, can be used. FIG. 8 shows a user wearing the vomit bag holder on a neck strap using the neck strap connector.

In an embodiment, the upper end 30 includes at least two neck strap connectors 70, symmetrically located on both sides of the vomit bag holder 10, to ensure the stability of the vomit bag holder 10 when suspended by a neck strap attached to the neck strap connectors 70. The two neck strap connectors 70 on or near the upper end 30 on each of the left side 22 and right side 24 can be diametrically opposed, or arranged in any other way to ensure the stability of the vomit bag holder 10 during and after use, whether the vomit bag holder 10 attached by a neck strap is suspended to, for example, the neck of the user, a hook, or a similar device. Positioning the neck strap connectors 70 transversally aligned with the center of gravity of the bag and holder combination, can help preventing unwanted tipping over of the bag's contents. In the illustrated embodiment, neck strap connectors 70 are provided at 0.541 inches from the upper end 30, in the middle of left side 22 and right side 24. The head of the protrusion is 0.198 inches wide.

The neck strap can be a ribbon able to support the weight of the vomit bag holder holding a vomit bag full of vomit. A paper or cardboard ribbon could be used, for example. However, it should be easily breakable and/or easily releasable from the neck strap connector to ensure that interventions, such as medical interventions, can be done on the user rapidly and efficiently. In one embodiment, the neck strap is a perforated cardboard ribbon, and the neck strap connectors 70 are protrusions, the user selecting a hole for the ribbon in which to penetrate the protrusion for each side, depending on a required position of the vomit bag holder on his chest. The cardboard ribbon can break next to a perforation if a sufficient threshold force is applied on the vomit bag holder. Alternatively, one or both of the neck strap connector can break if a sufficient threshold force is applied on the vomit bag holder, thereby ensuring access to the abdomen of the user.

The rear side 28 of the vomit bag holder 10 further includes a downwardly protruding gripping arm 80, extending from or near the upper end 30 of the vomit bag holder 10. The gripping arm 80 can be directly extending from or near the upper end 30, or be joined to or near the upper end 30 by a hinge 82 attached to the arm top 84, or by any other kind of similar arrangement.

The downwardly protruding arm for engaging a graspable structure can be defined by the rear section 28 of the tubular wall itself. More particularly, both apertured handles 62 are aligned thereby defining a continuous channel wherein the graspable structure can be inserted. Thus, to engage a graspable structure (not shown), the structure is inserted in both apertured handles 62. This is shown in FIG. 7 and in FIG. 2 where the graspable structure is shown in broken lines.

The gripping arm 80 allows for the engaging or gripping of the vomit bag holder 10 on any graspable structure, such as and without being limitative a bed safety rail, providing stability to the gripped vomit bag holder 10, prior or after use. Preferably, the tilting of the gripped vomit bag holder 10 is sufficiently limited to avoid spilling of the vomit contained in the vomit bag.

The gripping arm 80 can be flexibly and resiliently extending from or near the upper end 30, in a way that allows for a backward displacement of the gripping arm 80 relative to the plane to the rear side 28 of the vomit bag holder 10. The displacement of the gripping arm 80 away from the rear wall 28 creates a space defined by the side walls 22, 24 and the gripping arm 80, in which a graspable structure can be removably inserted or engaged. Preferably, when the force resiliently spacing the gripping arm 80 away is removed, the gripping arm 80 moves towards holder, removably engaging, retaining or gripping, any graspable structure inserted between the gripping arm 80 and the side walls 22, 24. Examples of graspable structure to be used with such an embodiment of the invention include the arm of an armchair or of a wheel chair, or the wall or rail on the side of a hospital bed.

In an alternative embodiment, the arm bottom 86 is spaced-apart from the rear of the vomit bag holder 10, when not in use. The spacing between the arm bottom 86 and the vomit bag holder 10 is sized and shaped to removably engage any graspable structure inserted between the gripping arm 80 and the rest of the holder.

In an embodiment, the resilient force of the gripping arm 80 towards the holder increases the stability of the gripped vomit bag holder 10 and limits its tilting. The tilting can be frontal (perpendicular to the plane of the rear wall 28) or lateral (parallel to the plane of the rear wall 28). It will be understood that a greater resilient force is needed to prevent the lateral tilting of the vomit bag holder 10 than the frontal tilting. The length of the gripping arm 80 should be sufficient to stably grip the vomit bag holder 10 to the graspable structure, such as, for example, at least one fourth, preferably one half, and more preferably the full height of the vomit bag holder 10. The width and thickness of the gripping arm 80 should also be sufficient to stably hold the gripped vomit bag holder 10 to the graspable structure and limit its tilting. Alternately, two or more interspaced grips or arms can be used instead of one, for example.

Referring now to FIGS. 9 to 15, therein shown an embodiment of a two-piece portable urinal device 110 will be described.

The two-piece portable urinal device 110 has a bag receiving portion 112 having a substantially tubular shape and a handle portion 114 removably attached to the bag receiving portion 112 as it will be described in more details below.

In the embodiment shown, the bag receiving portion 112 has a tubular wall 120 forming the body of the urinal device 110 and defining an internal hollow space. The tubular wall 120 has an upper end 130 longitudinally opposite to a lower end 140. The transversal cross-section of the urinal device is of oval shape, although other cross-sectional shapes can be used in alternate embodiments. In the illustrated embodiment, the bag receiving portion 112 has a width of about 9 cm and a length of about 12 cm.

In the embodiment shown, the height of the bag receiving portion 112 at a front end is greater than the height of the bag receiving portion 112 at a rear end, opposed to the front end and next to the handle portion 114. In the illustrated embodiment, the height of the urinal device 110 at the front end, which corresponds to the distance between the upper end 130 and the lower end 140 at the front end, is about 6 cm and the height of the urinal device 110 at the rear end, which corresponds to the distance between the upper end 130 and the lower end 140 at the first end, is about 3 cm.

In an alternative embodiment (not shown), the height of the bag receiving portion 112 at the rear end, next to the handle portion 114, can be greater or substantially equal to than the height of the bag receiving portion 112 at the front end.

Figure 9:
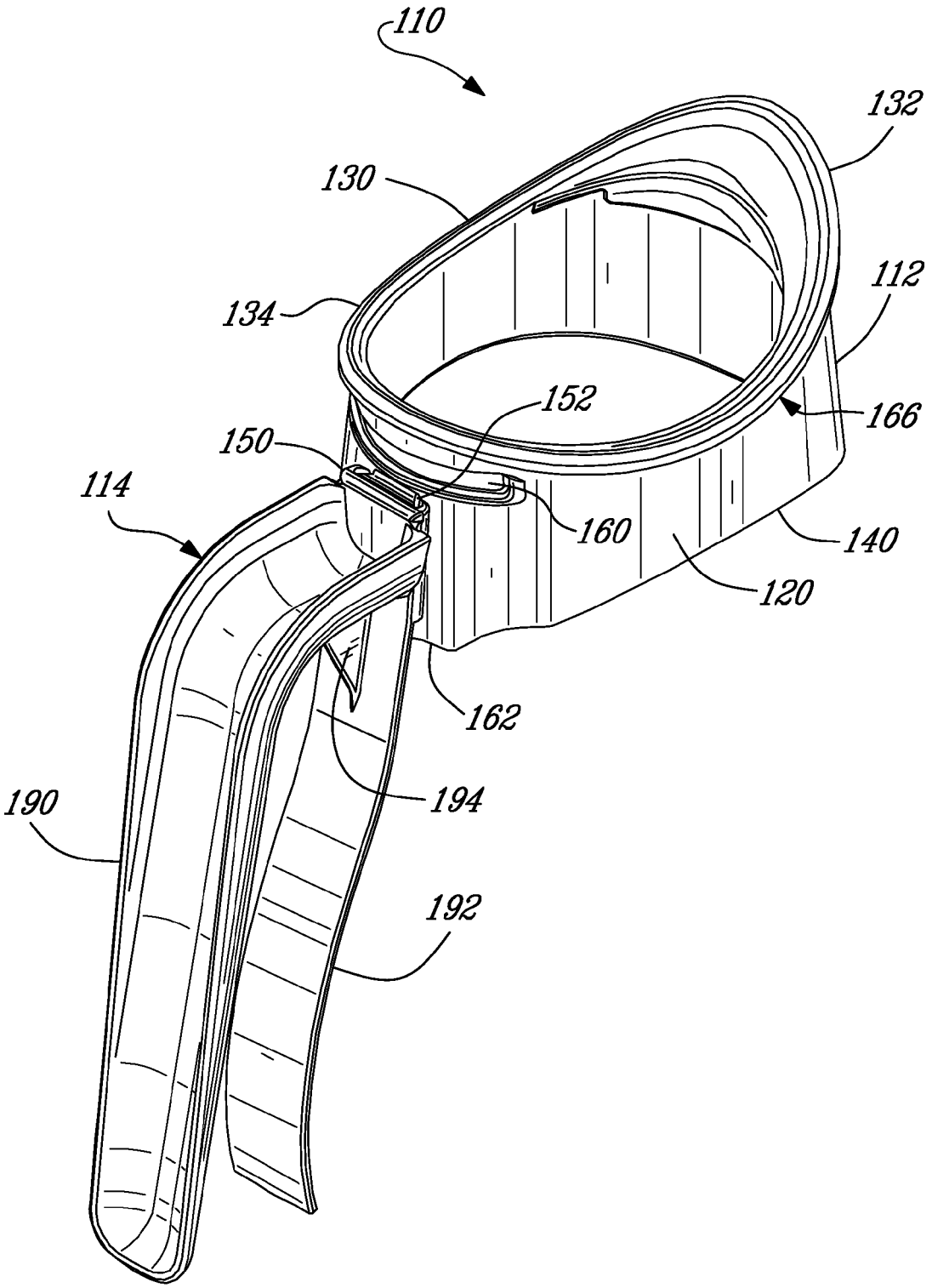
FIG. 9 is a perspective view of an embodiment of a two-piece portable urinal device.
Figure 10:
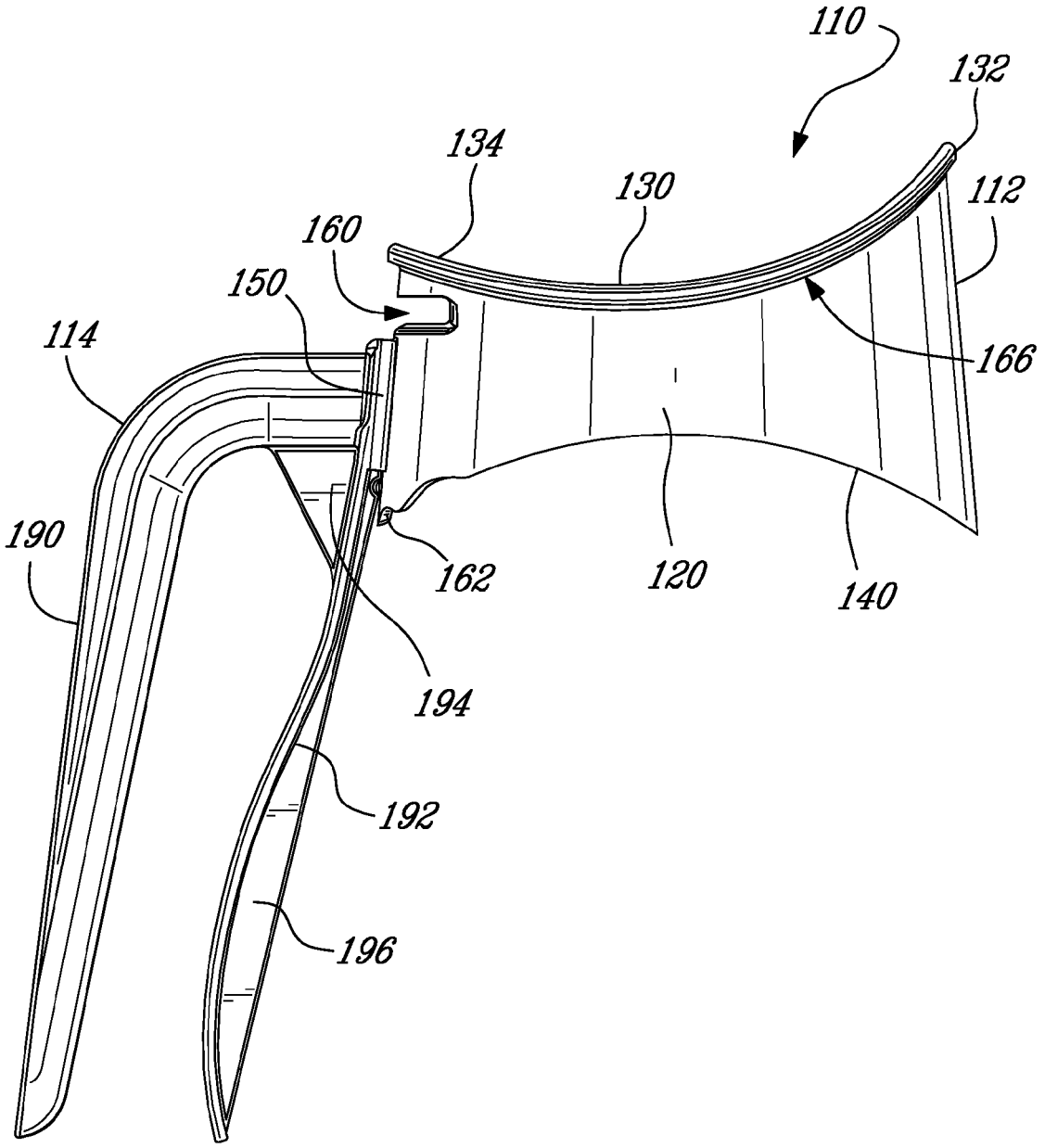
FIG. 10 is a side elevation view of the portable urinal device shown in FIG. 9.

The ends 130 and 140 can have a rounded shape. More particularly, a top edge of upper end 130 is curved along the length of the bag receiving portion 112 and along its width for better fitting around the user's genital area. Additionally, the bottom edge of lower end 140 is curved along the length of the bag receiving portion 112 and along its width. The tubular wall 120 can also outwardly bend at an end, particularly at the upper end 30, in a pointed or rounded way, to form a rim 132, as illustrated in FIGS. 9 and 10. It is appreciated that various designs can be applied to the upper end 130 and lower end 140 of the tubular wall 120, and to the top 134 of the urinal device, in order to increase comfort when in contact with or applied near the genitals of a user.

The upper end 130 and the lower end 140 can be formed by the continuity of the tubular wall 120 and produced as such, or be assembled to the tubular wall 120 after being separately manufactured. In other words, the bag receiving portion 112 can be single piece or multi-pieces. Furthermore, the upper end 130 and lower end 140 can be made of a different materials than the tubular wall 120, such as, for example, a material having an improved smoothness or an improved flexibility over the material of the tubular wall 120.

Located at or near the upper end 130 is a bag attachment. The urinal device 110 is designed for use with disposable hygienic bags 188 (FIG. 11) which are shaped to fit the particular design of the urinal device 110, and to be removably securable to the bag attachment. Typically, the body portion of a hygienic bag 188 is inserted into the hollow space defined by the tubular wall 120, with the open end of the hygienic bag 188 being secured to the bag attachment, at the upper end 130 of the tubular wall 120.

Figure 11:
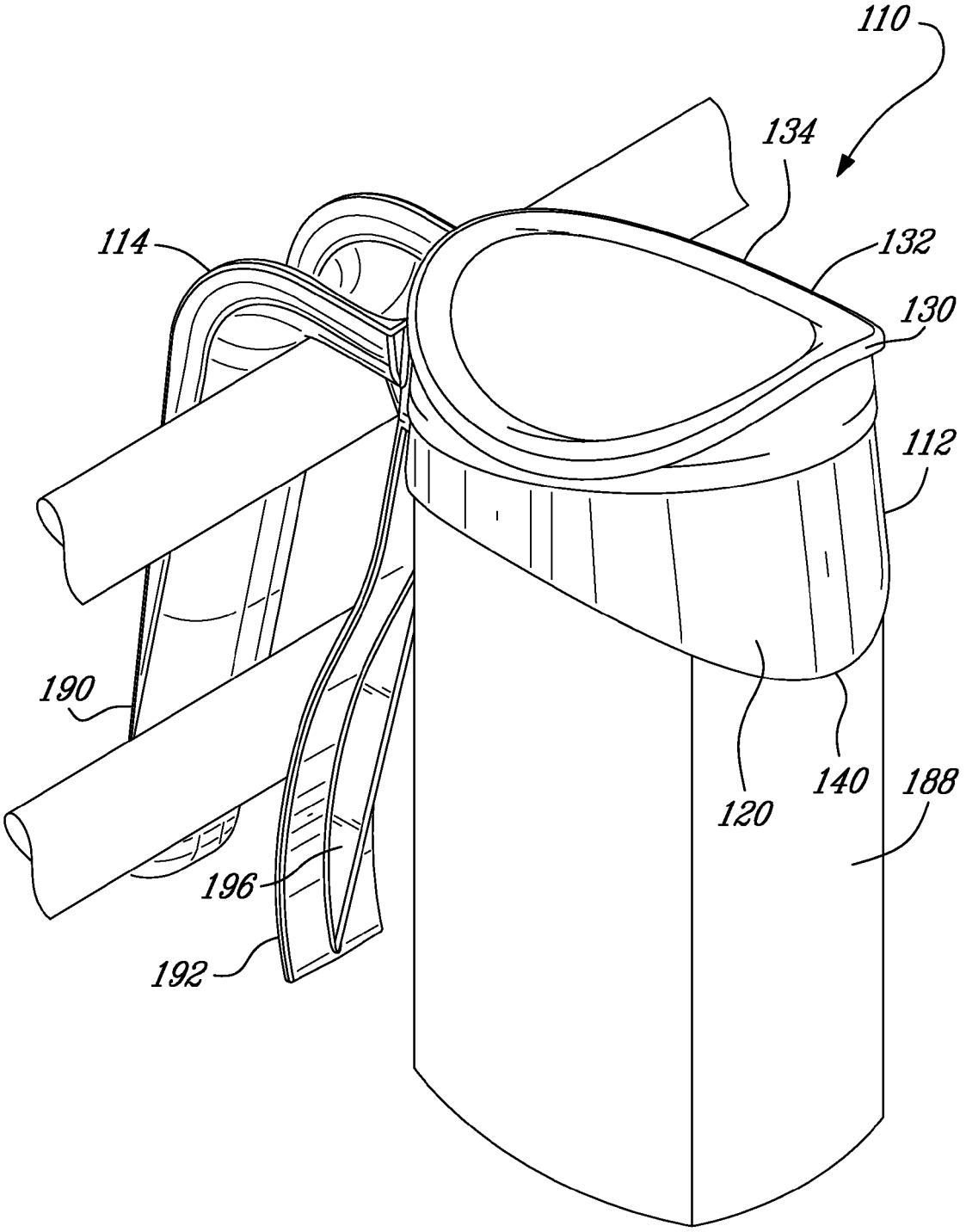
FIG. 11 is a perspective view of the portable urinal device shown in FIG. 9 with a urinal bag mounted thereto and gripped on a bed rail.

Shown in FIGS. 9 and 10 is a bag attachment including the outwardly and downwardly extending rim 132 spaced-apart from the upper end 130 and defining, with the tubular wall 120, a peripheral channel 166. The peripheral channel 166 is designed to receive therein an upper edge of the hygienic bag 188. The closure means of the bag 188, if any, can be used to secure the bag 188 to the urinal device 110. For example, if the bag 188 includes a closure string slidably mounted to an upper end thereof, the closure string can be used to tie the opening of the bag 188 to the rim 132. The string is inserted in the peripheral channel 166 and tightened to secure the hygienic bag 188 to the urinal device 110. The hygienic bag 188, secured to urinal device 110, extends over the rim 132 and in the hollow internal space as shown in FIG. 11. In this embodiment shown and without being limitative, the hygienic bag 188 has a height of 38 cm and a width of 16 cm.

In an alternative embodiment, the bag 188 can be secured to the urinal device 110, by inserting its edge defining the open end in the internal hollow space by surrounding the lower end 140 of the tubular wall 120. Thus, the bag 188 covers the outer surface of the tubular wall 120 and extends into the internal hollow space.

Alternatively, the hygienic bag 188 can include an elastic band (not shown) or have resilient properties. Thus, the bag 188 is secured to the urinal device 110 by applying pressure to the outer face of the urinal device 110, proximate to the upper end 130.

Examples of other bag attachments include, without limitation, a pressure-operated attachment of the hygienic bag 188 onto the whole upper end 130 of the urinal device 110, a Velcro™-like attachment to or near the upper end 130, a plurality of attachment points such as protrusions, tips, pins, slits, snaps and the likes or any combination of male and female members. Care must, however, be taken in choosing the attachment as perforation or breakage of the hygienic bag 188 while held in the urinal device 110 is to be avoided.

The tubular wall 120 can be angled outwardly from the upper end 130 towards the lower end 140 to prevent flow of urine from the hygienic bag 188 back onto the user's buttocks when in use with a user in a semi-seated or lying down position.

A double-purpose aperture, such as slot 160, can also provided in the rear of tubular wall 120. It can first ensure that the bag 188 does not detach from the bag attachment once filled with urine. The size of the slot 160 is designed to receive and secure a portion of the periphery of the hygienic bag 188 and ensures that the closure means can more securely fasten the bag 188 to the urinal device 110. Secondly, it can be used as a handle. Indeed, this slot 160 can be used in combination with either the upper end 130 or the lower end 140 to create an apertured handle when the handle portion 114 is absent from the urinal device 110.

Figure 12:
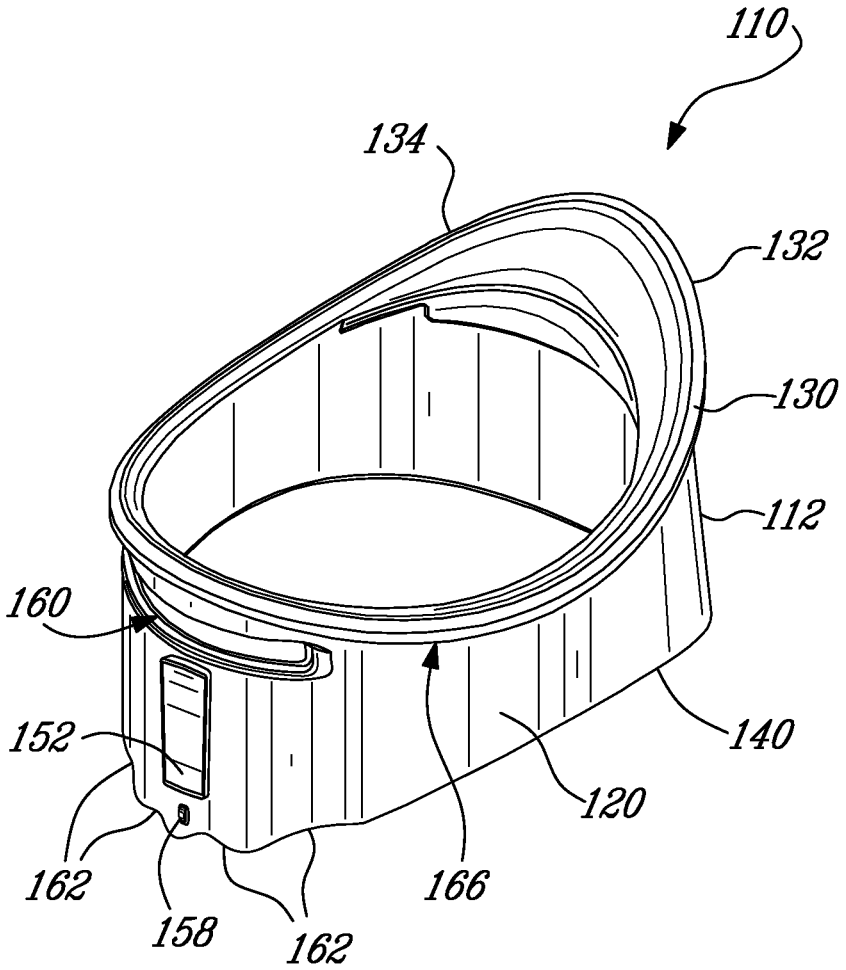
FIG. 12 is a perspective view of the bag receiving portion of the portable urinal device shown in FIG. 9.
Figure 13:
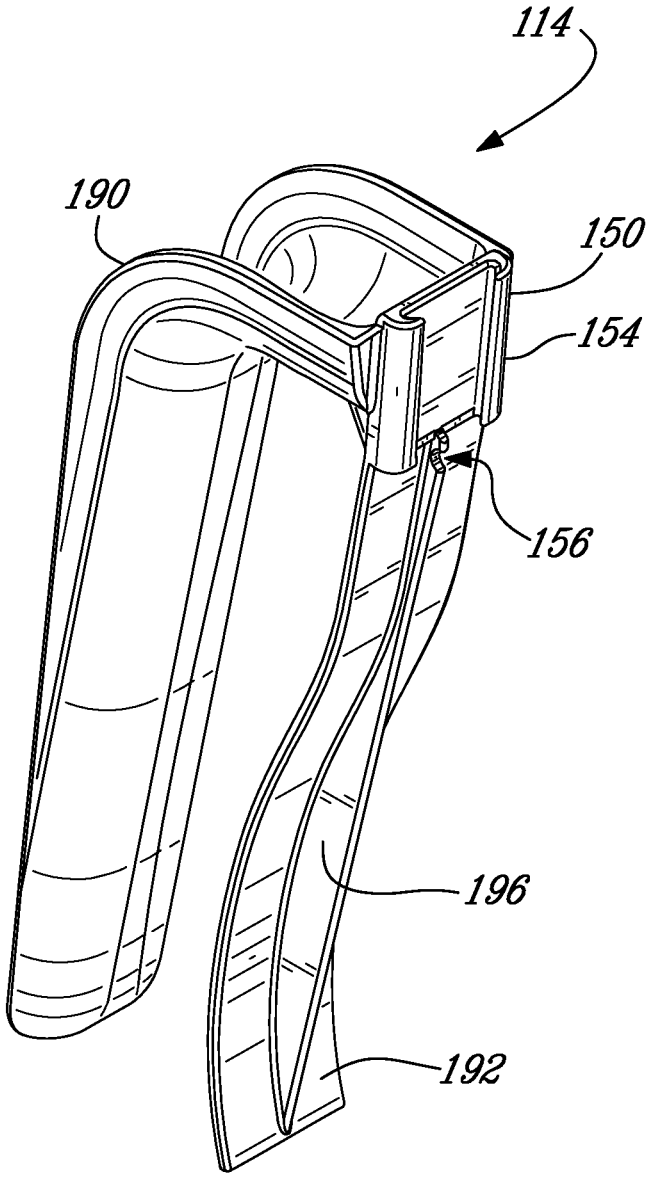
FIG. 13 is a perspective view of the handle portion of the portable urinal device shown in FIG. 9.

When used in combination with upper end 130, at least one finger of one hand of the user is inserted in slot 160. The thumb of the same hand is hooked around the rim 132 of the upper end 130 and the hand is then able to control placement of the urinal device 110 appropriately (FIG. 12).

When used in combination with lower end 140, the thumb of one hand of the user is inserted in slot 160. At least one finger of the same hand and hooked around the edge of lower end 140 and the hand is then able to control placement of the urinal device 110 appropriately. The edge of lower end 140 can be provided with up to four waved-shaped recesses 162 centrally located along the rear of the lower end 140 for better gripping of the urinal device 110.

The waved-shaped recesses 162 centrally located along the rear of the lower end 140 can also be used for gripping of the urinal device 110 in combination with the rim 132 of the upper end 130. Indeed, up to four fingers can be hooked in the recesses 162 and the thumb of the same hand can be hooked around the rim 132 of the upper end 130. It is appreciated that the shape, number, and location of the recesses 162 can vary.

Figure 14:
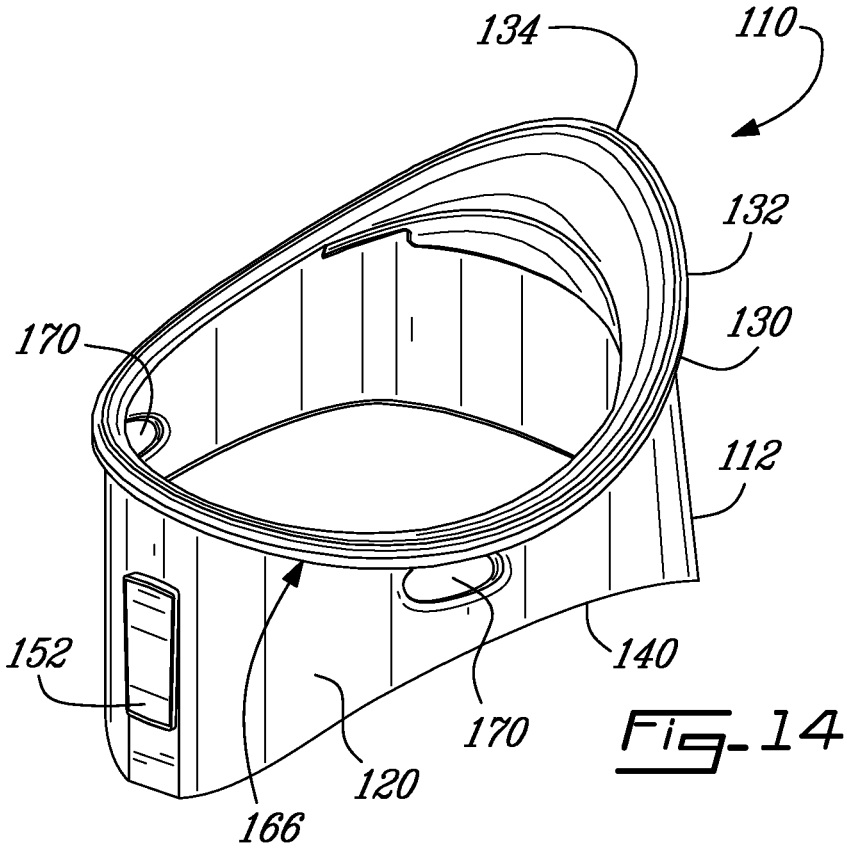
FIG. 14 is a perspective view of another embodiment of a two-piece portable urinal device wherein the bag receiving portion has apertured handles.
Figure 15:
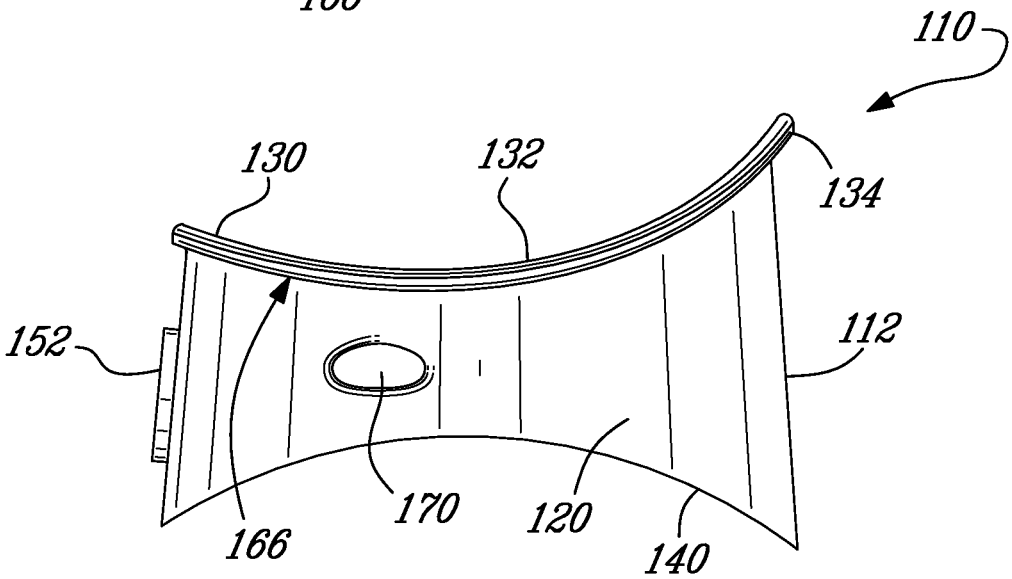
FIG. 15 is a side elevation view of the portable urinal device shown in FIG. 14.

Alternatively or additionally, FIGS. 14 and 15 show that a closed-figure shaped aperture 170 can be provided on each side of the bag receiving portion 112. The two apertures 170 face each other near the rear of the bag receiving portion 112. For use as a handle, a thumb is inserted in one aperture 170 and one of the remaining fingers of the same hand is hooked in the facing aperture 170. The curved rear of the bag receiving portion 112 is received in the palm of the hand and placement of the urinal device 110 can be controlled.

It is appreciated that the size, the design, and the location of the apertured handles 160, 170 can vary from the one shown in FIGS. 14 and 15. It is appreciated that the urinal device 110 can include one or more apertured handles 160, 170.

The removable handle portion 114 is located at the rear of the two-piece portable urinal device. In the embodiment shown, the handle portion 114 is longer than the bag receiving portion 112, i.e. it extends below the lower end 140 of the tubular wall 120 when attached thereto. The handle portion 114 can have a single elongated member (not shown) or can include two main elongated members defining an insertion channel in-between, a thumb elongated member 190 adapted to receive the thumb of one hand of the user in use and a finger elongated member 192 adapted to receive at least one remaining finger of the same hand. The cross-section of the thumb elongated member 190 is U-shaped to provide a channel for inserting the thumb of the user in use. It is curved at the top for comfort and ease of manipulation. The finger elongated member 192 includes an elongated structural member 196 which strengthens the handle (FIG. 10). In the illustrated example, the thumb elongated member 190 and the finger elongated member 192 have a length of about 17 cm.

The insertion channel extending between the thumb elongated member 190 and the finger elongated member 192 allows to rest the urinal device on a rail of a bed by inserting the thumb elongated member 190 and the finger elongated member 192 on either sides of the rail. Because of the curve in the finger elongated member 192, pressure needs to be applied to the urinal device to allow insertion over a rail, as shown in FIG. 11. However, finger elongated member 192 is sufficiently flexible to allow separation from thumb elongated member 190 to allow insertion of the rail all the way to the rail receiving support 194 of the finger elongated member 192.

The thumb elongated member 190 can be directly extending from the finger elongated member 192, or be joined to it by a hinge or by any other kind of similar arrangement.

The finger elongated member 192 can be flexibly and resiliently extending from the thumb elongated member 190, in a way that allows for a forward displacement of the finger elongated member 192 or a backward displacement of the thumb elongated member 190.

The insertion channel allows for the engaging or gripping of the urinal device 110 on any graspable structure, such as and without being limitative a bed safety rail, providing stability to the gripped urinal device 110, prior or after use. Preferably, the tilting of the gripped urinal device 110 is sufficiently limited to avoid spilling of the urine contained in the hygienic bag 188. Examples of graspable structure to be used with such the urinal device 110 include the arm of an armchair or of a wheel chair, or the wall or rail on the side of a hospital bed.

In an alternative embodiment, the finger elongated member 192 is spaced-apart from the thumb elongated member 190, when not in use. The spacing between the finger elongated member 192 and the thumb elongated member 190 is sized and shaped to removably engage any graspable structure inserted between the finger elongated member 192 and the thumb elongated member 190.

In an embodiment, the resilient force of the insertion channel increases the stability of the gripped urinal device 110 and limits its tilting. The tilting can be frontal or lateral. The length of the insertion channel should be sufficient to stably grip the urinal device 110 to the graspable structure. The width and thickness of the finger elongated member 192 and thumb elongated member 190 should also be sufficient to stably hold the gripped urinal device 110 to the graspable structure and limit its tilting. Alternately, two or more interspaced grips or arms can be used instead of one, for example.

If the handle portion 114 includes a single elongated member spaced-apart from the bag receiving portion 112, the graspable structure can be inserted in the spacing defined between the handle elongated member and the peripheral wall 120 of the bag receiving portion 112.

The handle portion 114 includes a handle attachment 150 which attaches the handle to the rear of the tubular wall 120 of the bag receiving portion 112 which is also provided with a body attachment 152. In the example shown in FIG. 13, the handle attachment 150 comprises a C-shaped clamp 154 adapted to be slid around an attachment member of the body attachment 152, shown in FIG. 12. In order for the handle attachment 150 to be securely held attached to the body attachment 152, a recess 156 is provided below the clamp 154 on the handle portion 114 and a protrusion 158 is provided below the attachment member of the body attachment 152. When the clamp 154 of the handle portion 114 is aligned and slid into place by moving the handle from below the bag receiving portion 112 towards the top of the bag receiving portion 112, to surround the attachment member of the body attachment 152, the protrusion 158 of the bag receiving portion 112 engages the recess 156 of the handle portion 114 and secures the handle 114 to the bag receiving portion 112. The handle portion 114 can be disengaged from the bag receiving portion 112 by applying pressure on the protrusion 158 within the recess 156 until the protrusion 158 is freed from the recess 156 and the clamp 154 is allowed to slide down from around the attachment member 152. In the illustrated example, the body attachment 152 has a height of about 2 to 3 cm with a width of about 1 to 2 cm. In an embodiment, the width at the base 152 is slightly larger at its top than at its base. The C-shaped clamp 154 is adapted to fit over the body attachment 152 and has corresponding dimensions.

It is appreciated that the handle portion 114 can be secured or removably attached to the bag receiving portion 112 by any other appropriate technique. For instance and without being limitative, the handle portion 114 can be single piece with the bag receiving portion 112. In another embodiment, each one of the handle portion 114 and the bag receiving portion 112 can include a respective one of a male and female members engageable with one another for securing the handle portion 114 and the bag receiving portion 112 together. It is appreciated that the shape of the male and female members is variable. It is also appreciated that the urinal device 110 can be handle free.

Prior to use, the body of the hygienic bag 188 is positioned into the hollow space defined by the tubular wall 120 and the open end of the hygienic bag 188 is maintained in an open state by being attached to the bag attachment of the urinal device 110. This arrangement allows for a ready access and immediate use of the hygienic bag, the hygienic bag 188 being secured in an open position by the bag attachment, as shown in FIG. 11.

In use, the user firmly grasps the urinal device 110 by holding it using the handle, if the handle portion 114 is attached to the bag receiving portion 112 or by grabbing the bag receiving portion 112 itself either using the lower and upper edges of the bag receiving portion 112 or using at least one of the apertured handles 160, 172. The user applies the urinal device 110 to his genital area. The user is then able to urinate inside the hygienic bag 188 provided in the urinal device 110.

After use, gravity acts on the urine inside the hygienic bag 188, which retains the hygienic bag 188 within the urinal device 110 by the bag attachment. After use, the used hygienic bag 188 is removed from the urinal device 110, tied and disposed of. In order to facilitate removal of the hygienic bag 188 from the urinal device 110, the urinal device 110 can first be inserted over a rail of a bed and then the bag 188 can more easily be lifted and removed from the urinal device 110.

In the illustrated embodiment, the lower end 140 of the urinal device 110 is open. In alternate embodiments, it can be closed. If it is closed, the tubular wall 120 will typically need to be longer to prevent urine from flowing towards the user if the user is in a semi-seated or lying down position.

In alternate embodiments, different shapes or forms of handles can be used instead of the handle described above and depicted. Also, a different configuration of apertures can be provided. Similarly, the shape, the design and the relative size of the bag receiving portion 112 and the handle portion 114 can vary from the one described above in reference to the figures. It is also appreciated that the bag attachment can vary. For instance and without being limitative, the hygienic bag 188 can be secured to the inside surface of the tubular wall 120 or to the upper end 130 of the tubular wall 120.

It is appreciated that the urinal device 110 can be single piece, i.e. it can be handle free or the handle can be permanently secured to the bag receiving portion 112.

In an embodiment, the hygienic bag and the vomit bag further includes an absorbent material layer, such as a gel, which captures liquids. The absorbent material layer substantially instantaneously holds liquids to ease handling. For example, neutralized, cured, and/or reticulated polyacrylate can be used. This absorbent material layer can form an integral part of the bag or can be provided separately and simply be placed in the bag.

The urinal device and the vomit bag holder are body liquid bag holders which are designed to receive a bag therein and maintain the bag in an open configuration. They can include aperture handles to allow a better grip of the body liquid bag holders.

The absorbent material layer can be a distinct component from the bag or it can be provided as a single-piece. For example, the gel agent can be in powder crystal or fiber form, spread out over or stuck to the bottom of the bag. It can be contained in a sachet which is placed or affixed to the bottom of the bag. For example, it can be glued. The sachet can be made of a water soluble material or made of a material that is made fragile by the liquid so that it breaks upon contact with it (e.g. paper or cellulose wadding). Alternatively, the gel agent can be inserted into a non-woven device or affixed to adhesive paper or simply affixed to or placed at the bottom of the bag.

The gel agent can include products to improve comfort conditions. For example, it can include deodorants, antiseptics, virucides, antiretroviral, microbicides, bactericides, fungicides, or reagents, etc.

In an embodiment, the hygienic or vomit bag is a prior art bag, made of a liquid-proof material. In an embodiment, the hygienic or vomit bag is a plastic bag. The hygienic or vomit bag should be sized for attachment to the bag attachment of the urinal device or the vomit bag holder.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A hand-held body liquid bag holder comprising a continuous tubular wall defining a hollow space adapted to receive a hygienic bag, and having an upper end, a lower end, opposed to the upper end, and opposed transversal sides with a front side and rear side extending therebetween;

a hygienic bag attachment adjacent to the upper end of the tubular wall configured to maintain the hygienic bag in an open state in the hollow space; and a first set of apertured handles including two slit openings extending through the tubular wall upwardly from the lower end of the tubular wall and being opened at the lower end of the tubular wall, each one of the slit openings extending through a respective one of the opposed transversal sides of the tubular wall, adjacent to the rear side, and being aligned with one another to selectively receive one of a straight graspable structure therein and a plurality of fingers of a respective hand of a user in each of the slit openings for supporting the body liquid bag holder; and a second set of apertured handles comprising two closed-figure shaped openings, each one of the closed-figure shaped openings extending through a respective one of the opposed transversal sides of the tubular wall, the closed-figure shaped openings being spaced-apart from the lower end of the tubular wall, closer to the opposed upper end, and adjacent to the front side of the tubular wall and being configured and adapted to receive a thumb of the hand of the user when fingers are received in the corresponding one of the slit openings;

the first and the second sets of apertured handles being outwardly exposed when the hygienic bag is received in the hollow space and engaged with the hygienic bag attachment.

2. The hand-held body liquid bag holder of claim 1, wherein said body liquid bag holder is a vomit bag holder.

3. The hand-held body liquid bag holder of claim 1, further comprising two additional slit openings extending through the tubular wall upwardly from the lower end and being open at the lower end of the tubular wall, the two additional slit openings being positioned on the front side of the tubular wall, between the two closed-figure shaped openings.

4. The hand-held body liquid bag holder of claim 1, wherein said body liquid bag holder is a vomit bag holder and said vomit bag holder further comprises at least a first and a second diametrically opposed neck strap connectors adjacent to the upper end of the tubular wall, the neck strap connectors being detachably engageable with a neck strap to allow the user to wear the body liquid bag holder around his neck.

5. The hand-held body liquid bag holder of claim 4, wherein said neck strap connectors are protrusions extending outwardly from opposite sides of said tubular wall.

6. The hand-held body liquid bag holder of claim 5, wherein each one of said protrusions is located between a respective one of said slit openings of said first set of apertured handles and a respective one of the closed-figure shaped openings of the second set of apertured handles extending through a same one of the transversal sides of the tubular wall.

7. The hand-held body liquid bag holder of claim 1, wherein said body liquid bag holder is a vomit bag holder and said tubular wall has a length between the upper end and the lower end at least that of the width of up to four fingers of a user.

8. The hand-held body liquid bag holder of claim 1, wherein the hand-held body liquid bag holder is opened at the lower end of the tubular wall.

9. The hand-held body liquid bag holder of claim 1, wherein the hygienic bag attachment comprises a rim extending outwardly and downwardly from the upper end of the tubular wall and being spaced-apart from the tubular wall to define a peripheral channel therebetween.

10. A hand-held body liquid bag holder comprising a continuous tubular wall having an upper end, a lower end, opposed to the upper end, and opposed transversal sides with front and rear sides extending therebetween and defining a hollow space therein;

a hygienic bag attachment adjacent to the upper end of the tubular wall;

a first set of apertured handles including slit openings, each one of the slit openings extending through a respective one of the transversal sides of the tubular wall upwardly from the lower end thereof and being open at the lower end of the tubular wall, the slit openings being adjacent to the rear side and aligned with one another to selectively receive one of a straight graspable structure extending in the first set of apertured handles and a plurality of fingers of a respective hand of a user in each of the slit openings for supporting the body liquid bag holder;

a second set of apertured handles comprising two closed-figure shaped openings, each one of the closed-figure shaped openings extending through a respective one of the transversal sides of the tubular wall, the closed-figure shaped openings being spaced-apart from the lower end of the tubular wall, closer to the opposed upper end, and adjacent to the front side of the tubular wall, the two closed-figure shaped openings being configured and adapted to receive a thumb of the hand of the user when fingers are received in the corresponding one of the slit openings; and a hygienic bag having an upper end engageable with the hygienic bag attachment with the hygienic bag extending in the hollow space defined by the tubular wall in an open state and the first and the second sets of apertured handles being outwardly exposed.

11. The hand-held body liquid bag holder of claim 10, wherein the hand-held body liquid bag holder is opened at the lower end of the tubular wall.

12. The hand-held body liquid bag holder of claim 10, wherein the hygienic bag attachment comprises a rim extending outwardly and downwardly from the upper end of the tubular wall and being spaced-apart from the tubular wall to define a peripheral channel therebetween to receive the upper end of the hygienic bag.

13. The hand-held body liquid bag holder of claim 1, wherein said body liquid bag holder is a vomit bag holder.

14. The hand-held body liquid bag holder of claim 13, wherein the tubular wall further comprises two additional slit openings extending through the tubular wall upwardly from the lower end and being open at the lower end of the tubular wall, the two additional slit openings being positioned on the front side of the tubular wall, between the two closed-figure shaped openings.

* * * * *